US011578551B2

(12) United States Patent
Yakeley

(10) Patent No.: US 11,578,551 B2
(45) Date of Patent: Feb. 14, 2023

(54) RUNNING TOOL INCLUDING A PISTON LOCKING MECHANISM

(71) Applicant: Sean Yakeley, Houston, TX (US)

(72) Inventor: Sean Yakeley, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 61 days.

(21) Appl. No.: 17/232,304

(22) Filed: Apr. 16, 2021

(65) Prior Publication Data

US 2022/0333452 A1 Oct. 20, 2022

(51) Int. Cl.
*E21B 23/04* (2006.01)
*E21B 43/10* (2006.01)

(52) U.S. Cl.
CPC ..... *E21B 23/042* (2020.05); *E21B 43/10* (2013.01)

(58) Field of Classification Search
CPC ..... E21B 23/04; E21B 23/042; E21B 43/10
See application file for complete search history.

(56) References Cited

U.S. PATENT DOCUMENTS 4,067,062 A * 1/1978 Baugh ..... E21B 33/047 166/212
4,077,472 A * 3/1978 Gano ..... E21B 33/043 166/359
5,133,412 A * 7/1992 Coronado ..... E21B 23/06 166/123
5,370,186 A * 12/1994 Ireland ..... E21B 17/06 166/212
6,082,460 A * 7/2000 June ..... E21B 33/04 166/368
10,597,986 B2 * 3/2020 Burke ..... E21B 23/04
10,947,799 B2 * 3/2021 Perez ..... E21B 23/01
2005/0092495 A1 5/2005 Evans
2005/0150693 A1 7/2005 Madden
2013/0180715 A1 * 7/2013 Harris ..... E21B 23/06 166/208
2015/0047853 A1 * 2/2015 Hurtado ..... E21B 23/12 166/377

(Continued)

FOREIGN PATENT DOCUMENTS

EP 2835493 A1 2/2015

OTHER PUBLICATIONS

International Search Report and Written Opinion for International Application No. PCT/US2022/071507; International Filing Date Apr. 1, 2022; dated Jul. 25, 2022 (pp. 1-10).

*Primary Examiner* — Shane Bomar
(74) *Attorney, Agent, or Firm* — Cantor Colburn LLP

(57) ABSTRACT

A liner hanger running system including a liner hanger having a body including a wall defined by an outer surface and an inner surface. The body includes an opening that extends through the outer surface and the inner surface. A piston housing including a wall portion defined by an outer surface portion and an inner surface portion is spaced from the outer surface of the body to define a piston Chamber exposed to the opening. A piston is arranged in the piston chamber. A liner hanger running tool including a dog key extends into the opening and engages the piston. The dog key is selectively shiftable relative to the liner hanger to release the piston and expose the opening to a setting pressure.

20 Claims, 5 Drawing Sheets

(56) References Cited

U.S. PATENT DOCUMENTS

| | | | | |
|---|---|---|---|---|
| 2015/0233215 | A1* | 8/2015 | Yeh | E21B 43/082<br>166/278 |
| 2017/0239727 | A1 | 8/2017 | Oxford | |
| 2020/0240241 | A1 | 7/2020 | Oprea | |
| 2021/0310338 | A1* | 10/2021 | Turley | E21B 23/042 |

* cited by examiner

RUNNING TOOL INCLUDING A PISTON LOCKING MECHANISM

BACKGROUND

In the resource exploration and recovery industry, liner hangers are often used to support internal wellbore surfaces as well as provide support for various downhole tools and tubulars. A liner hanger is typically anchored in a wellbore to a lowermost casing tubular through hanger slips and a packer element. The liner hanger is run in and secured in place with a liner running tool. The liner running tool provides a platform for holding the liner hanger during a trip into the wellbore, tools used to activate packers and slips, and systems for disconnecting the liner running tool from the liner hanger. The liner running tool may also support additional tools that may be used to perform other tasks. Once disconnected, the liner running tool may be used to perform the other tasks and/or be removed from the wellbore.

The liner hanger generally includes a setting piston arranged in a liner hanger wall and a piston housing. Pressure may be applied to the setting piston through a port in the liner hanger body to activate, for example, an anchor. The pressure creates a force that acts against the setting piston to shift the anchor. During run in, the pressure port and associated pressure chamber are exposed to solid-laden fluids which may prevent the setting piston from shifting. Further, external mechanical loads perceived by the liner hanger may prematurely shift the setting piston and activate the anchor. Failure to set the anchor and/or prematurely setting the anchor can result in significant downtime thereby increasing costs on forming the well. Therefore, the industry would welcome additional systems for setting an anchor including fewer parts and which are less prone to setting failures.

SUMMARY

Disclosed is a liner hanger running system including a liner hanger having a body including a wall defined by an outer surface and an inner surface. The body includes an opening that extends through the outer surface and the inner surface. A piston housing including a wall portion defined by an outer surface portion and an inner surface portion is spaced from the outer surface of the body to define a piston chamber exposed to the opening. A piston is arranged in the piston chamber. A liner hanger running tool including a clog key extends into the opening and engages the piston. The dog key is selectively shiftable relative to the liner hanger to release the piston and expose the opening to a setting pressure.

Also disclosed is a resource exploration and recovery system including a surface system, a subsurface system including a well bore, a casing extending into the wellbore, and a liner hanger running system. The liner hanger running system includes a body having a wall defined by an outer surface and an inner surface. The body includes an opening that extends through the outer surface and the inner surface. A piston housing including a wall portion defined by an outer surface portion and an inner surface portion is spaced from the outer surface of the body to define a piston chamber exposed to the opening. A piston is arranged in the piston chamber. A liner hanger running tool including a dog key extends into the opening and engages the piston. The dog key is selectively shiftable relative to the liner hanger to release the piston and expose the opening to a setting pressure.

Further disclosed is a method of shifting a piston in a liner hanger. The method includes running a liner hanger into a wellbore on a liner hanger running tool, releasing a dog key extending through an opening in the liner hanger into a piston chamber and engaging a piston, directing fluid through the opening into the piston chamber, and shifting the piston in the piston chamber.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
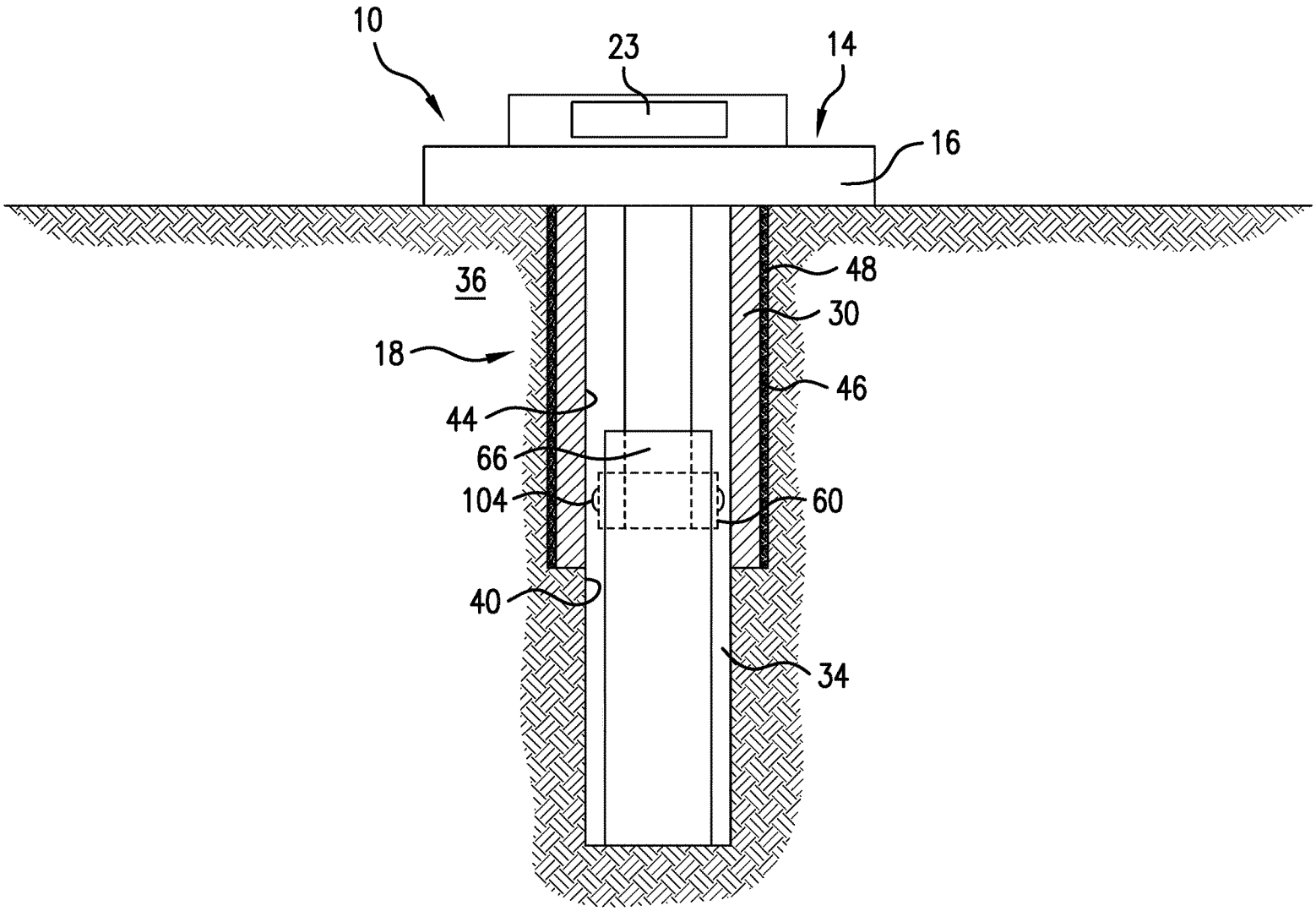
FIG. 1 depicts a resource exploration and recovery system including a liner hanger and liner hanger running tool, in accordance with a non-limiting example.

A resource exploration and recovery system, in accordance with a non-limiting example, is indicated generally at 10, in FIG. 1. Resource exploration and recovery system 10 should be understood to support well drilling operations, completions, resource extraction and recovery, $CO_2$ sequestration, and/or the like. Resource exploration and recovery system 10 may include a first system 14 which, in some environments, may take the form of a surface system 16 operatively and fluidically connected to a second system 18 which, in some environments, may take the form of a subsurface or downhole system (not separately labeled).

First system 14 may include a control system 23 that may provide power to, monitor, communicate with, and/or activate one or more downhole operations. Surface system 16 may include additional systems such as pumps, fluid storage systems, cranes, and the like (not shown). Second system 18 may include a casing tubular 30 that extends into a wellbore 34 formed in a formation 36.

Casing tubular 30 may be part of a completion (not separately labeled) and could be formed from a plurality of interconnected tubulars (also not separately labeled). Wellbore 34 includes an annular wall 40 which may be defined by a surface of formation 36. Casing tubular 30 includes an inner surface 44 and an outer surface 46. An amount of cement 48 is disposed between outer surface 46 and annular wall 40 to secure casing tubular 30 in wellbore 34. In a non-limiting example, a liner hanger 60 is connected to inner surface 44 of casing tubular 30. Liner hanger 60 is tripped in and secured in place with a liner hanger running tool 66.

Figure 2:
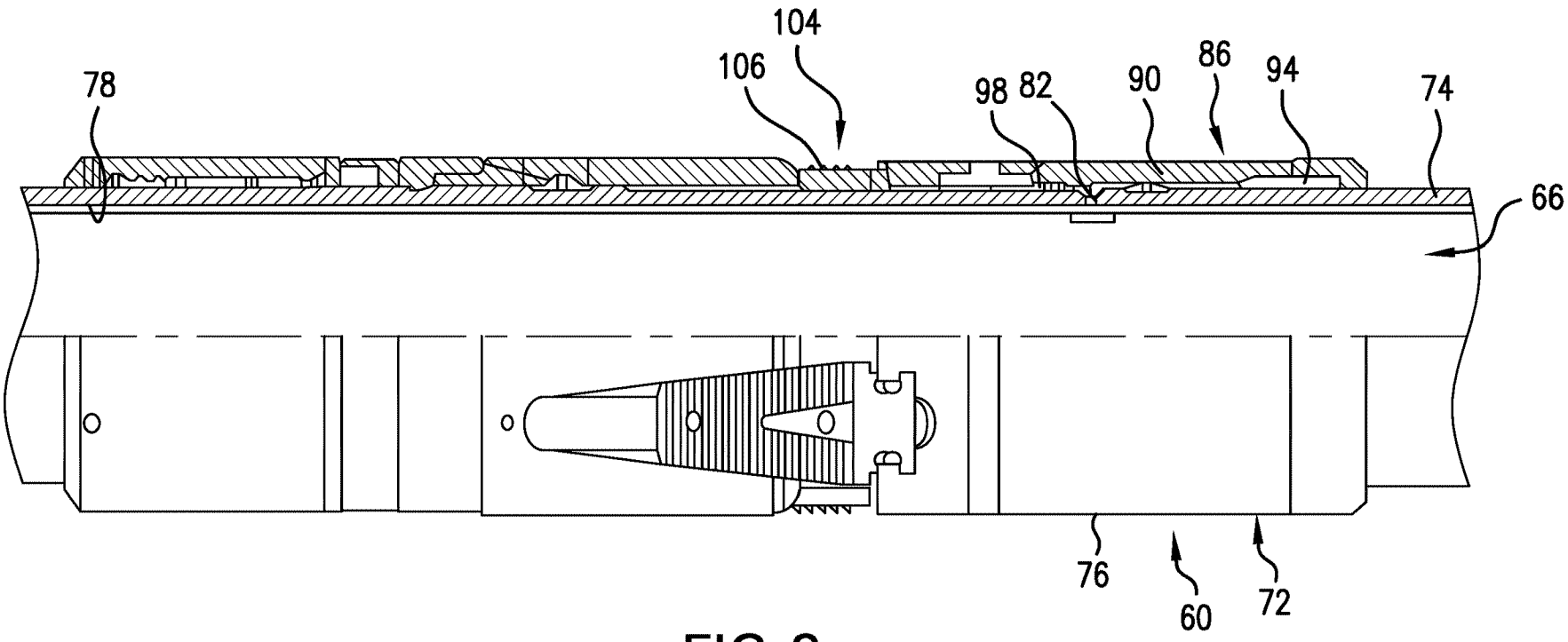
FIG. 2 depicts the liner hanger and liner hanger running tool of FIG. 1, in accordance with a non-limiting example.
Figure 3:
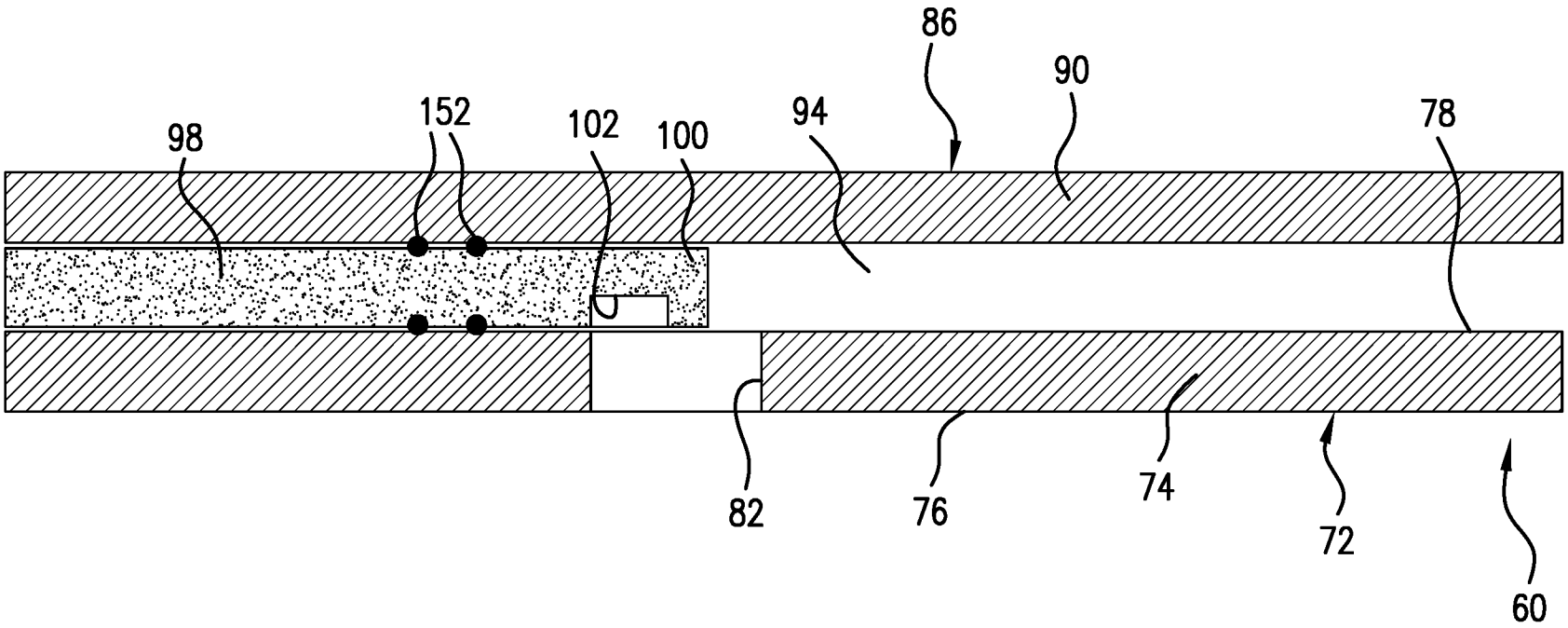
FIG. 3 depicts a cross-sectional side view of an opening in a piston chamber housing a piston in the liner hanger of FIG. 2, in accordance with a non-limiting example.

Reference will now follow to FIGS. 2 and 3 with continued reference to FIG. 1 in describing liner hanger 60 in accordance with a non-limiting example. Liner hanger 60 includes a body 72 defined by a wall 74 having an outer surface 76 and an inner surface 78. An opening 82 extends through wall 74 between outer surface 76 and inner surface 78. A piston housing 86 is disposed on wall 74 over opening 82. Piston housing 86 includes a wall portion 90 that is spaced from outer surface 76 so as to define a piston chamber 94. In a non-limiting example, a piston 98 is arranged in piston chamber 94. Piston 98 includes an end portion 100 having a recess 102 that is selectively aligned with opening 82. Piston 98 is operatively connected to an anchor 104 that may include one or more slips 106 provided on outer surface 76.

Figure 4:
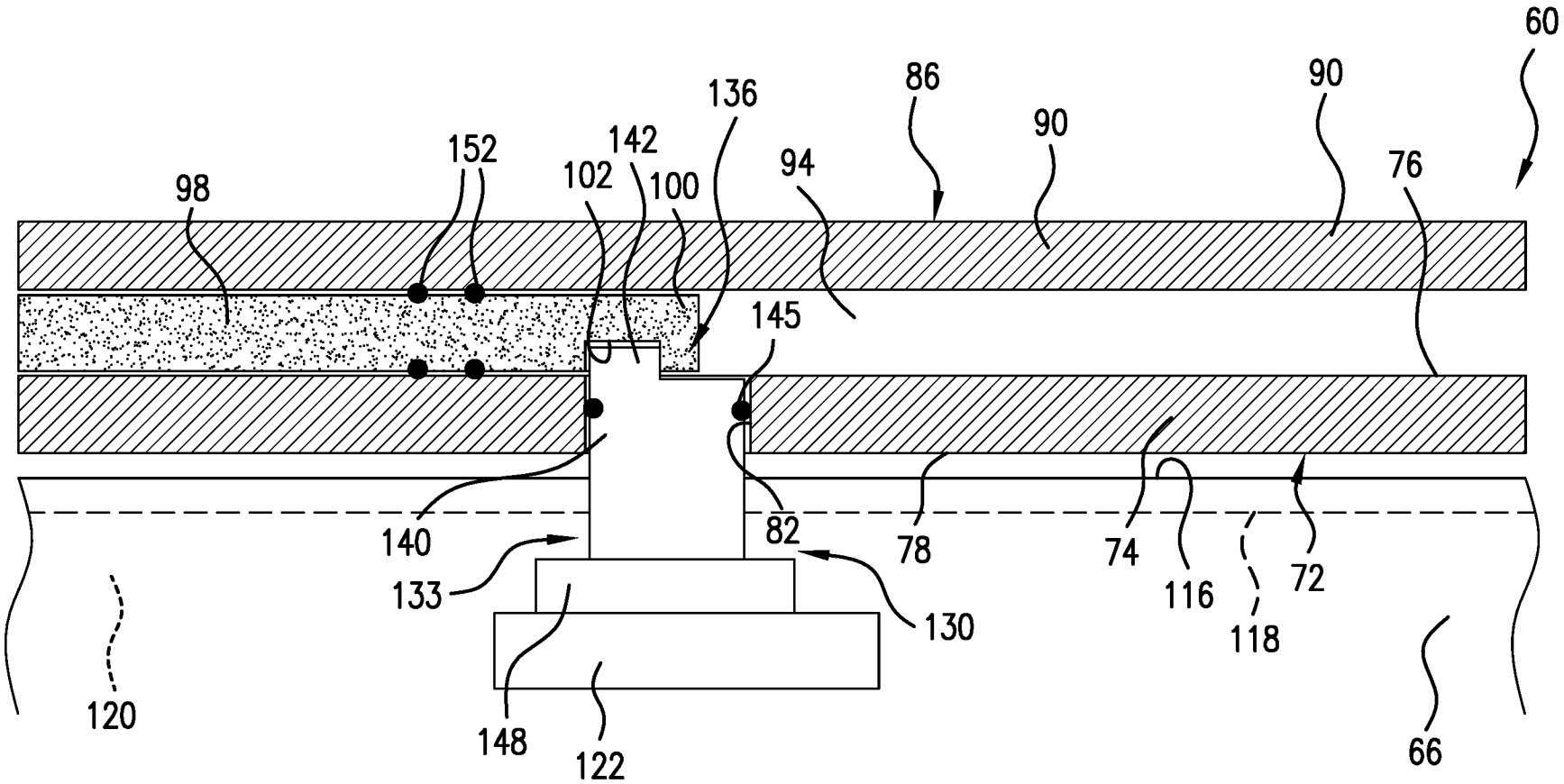
FIG. 4 depicts a dog key extending through the opening and engaging with the piston of FIG. 3, in accordance with a non-limiting example.

Referring now to FIG. 4 and with continued reference to FIGS. 1-3, liner hanger running tool 66 includes an outer surface portion 116 and an inner surface portion 118 that defines a conduit 120. A dog support sleeve 122 is slideably mounted in conduit 120. Dog support sleeve 122 may be part of an inner sleeve (not separately labeled) that may be shifted axially within conduit 120. A dog key 130 is selectively disposed between dog support sleeve 122 and piston 98.

In accordance with a non-limiting example, dog key 130 includes a first end 133 and a second end 136. Second end 136 includes a first portion 140 having a first dimension and a second portion 142 having a second dimension that is less than the first dimension. The second portion 142 engages with piston 98 in recess 102. A seal 145 is positioned on first portion 140. Seal 145 engages with surfaces (not separately labeled) of opening 82 to prevent solid-laden fluids from entering into piston chamber 94. Seal 145 together with additional seals 152 on piston 98 reduces fouling of piston 98 to promote a more reliable anchor setting operation.

Figure 5:
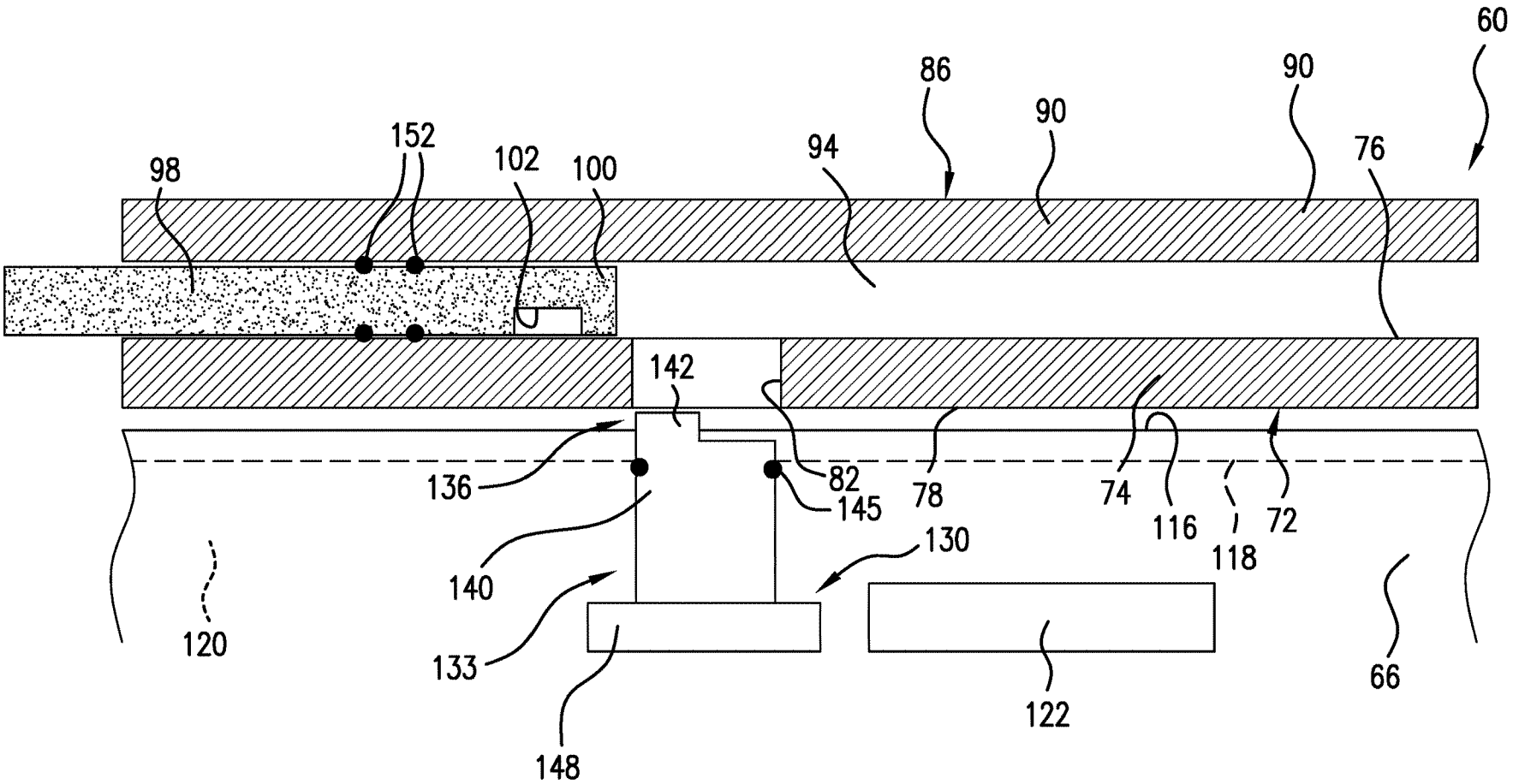
FIG. 5 depicts the dog key being released from the piston, in accordance with a non-limiting example.

In a non-limiting example, liner hanger 60 is run in on liner hanger running tool 66 with dog key 130 extending through openings 82 and retained by dog support sleeve 122 as shown in FIG. 4. Once liner hanger is in position, such as shown in FIG. 1, dog support sleeve 122 may be shifted axially relative to liner hanger running tool 66 thereby releasing dog key 130 as shown in FIG. 5. Dog key 130 shifts radially inwardly into conduit 120 thereby releasing piston 98. Control system 23 may then generate a fluid flow that create pressure that is applied to piston 98 via openings 82 to set anchor 104. By blocking off opening 82 with dog key 130, solid-lade fluids cannot enter into piston chamber 94 and foul piston 98. Further, retaining dog key 130 with dog sleeve 122, the likelihood that anchor 104 sets prematurely is eliminated. At this point, it should be understood that while shown as a single piston and dog key, the number and orientation of pistons and dog keys may vary.

Set forth below are some embodiments of the foregoing disclosure:

Embodiment 1. A liner hanger running system comprising: a liner hanger including a body having a wall defined by an outer surface and an inner surface, the body including an opening that extends through the outer surface and the inner surface; a piston housing including a wall portion defined by an outer surface portion and an inner surface portion that is spaced from the outer surface of the body to define a piston chamber exposed to the opening; a piston arranged in the piston chamber; and a liner hanger running tool including a dog key extending into the opening and engaging the piston, the dog key being selectively shiftable relative to the liner hanger to release the piston and expose the opening to a setting pressure.

Embodiment 2. The liner hanger running system according to any prior embodiment, wherein the liner hanger running tool includes a dog support sleeve that selectively retains the dog key in the opening.

Embodiment 3. The liner hanger running system according to any prior embodiment, wherein the piston includes an end portion that selectively extends over a portion of the opening, the end portion including a recess receptive of the dog key.

Embodiment 4. The liner hanger running system according to any prior embodiment, wherein the dog key includes a first end and a second end having a first portion including a first dimension and a second portion having a second dimension that is less than the first dimension, the second portion extending into the recess.

Embodiment 5. The liner hanger running system according to any prior embodiment, wherein the first portion of the dog key includes a seal.

Embodiment 6. The liner hanger running system according to claim 4, wherein the first end of the dog key includes a flange element that selectively abuts the dog support sleeve.

Embodiment 7, A resource exploration and recovery system comprising: a surface system; a subsurface system including a well bore, a casing extending into the wellbore, and a liner hanger running system comprising: a liner hanger including a body having a wall defined by an outer surface and an inner surface, the body including an opening that extends through the outer surface and the inner surface; a piston housing including a wall portion defined by an outer surface portion and an inner surface portion that is spaced from the outer surface of the body to define a piston chamber exposed to the opening; a piston arranged in the piston chamber; and a liner hanger running tool including a dog key extending into the opening and engaging the piston, the dog key being selectively shiftable relative to the liner hanger to release the piston and expose the opening to a setting pressure.

Embodiment 8. The resource exploration and recovery system according to any prior embodiment, wherein the liner hanger running tool includes a dog support sleeve that selectively retains the dog key in the opening.

Embodiment 9. The resource exploration and recovery system according to any prior embodiment, wherein the piston includes an end portion that selectively extends over a portion of the opening, the end portion including a recess receptive of the dog key.

Embodiment 10. The resource exploration and recovery system according to any prior embodiment, wherein the dog key includes a first end and a second end having a first portion including a first dimension and a second portion having a second dimension that is less than the first dimension, the second portion extending into the recess.

Embodiment 11. The resource exploration and recovery system according to any prior embodiment, wherein the first portion of the dog key includes a seal.

Embodiment 12. The resource exploration and recovery system according to any prior embodiment, wherein the first end of the dog key includes a flange element that selectively abuts the dog support sleeve.

Embodiment 13. The resource exploration and recovery system according to any prior embodiment, wherein the liner hanger includes an anchor, the piston being operatively connected to the anchor.

Embodiment 14. The resource exploration and recovery system according to any prior embodiment, wherein the anchor includes at least one slip arranged on the outer surface.

Embodiment 15. A method of shifting a piston in a liner hanger, the method comprising: running a liner hanger into a wellbore on a liner hanger running tool; releasing a dog key extending through an opening in the liner hanger into a piston chamber and engaging a piston; directing fluid through the opening into the piston chamber; and shifting the piston in the piston chamber.

Embodiment 16. The method according to any prior embodiment, wherein running the liner hanger into the well bore includes sealing the opening with the dog key to prevent solid-laden fluids to pass into the piston chamber.

Embodiment 17. The method according to any prior embodiment, wherein releasing the dog key includes shifting the liner hanger running tool relative to the liner hanger.

Embodiment 18. The method according to any prior embodiment, wherein shifting the liner hanger running tool releases the dog key to move radially inwardly.

Embodiment 19. The method according to any prior embodiment, wherein shifting the liner hanger running tool includes axially moving a support sleeve relative to the dog key.

Embodiment 20. The method according to any prior embodiment, wherein releasing the dog key includes disengaging an end of the dog key from a recess in the piston.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A liner hanger running system comprising:

a liner hanger including a body having a wall defined by an outer surface and an inner surface, the body including an opening that extends through the outer surface and the inner surface;

a piston housing including a wall portion defined by an outer surface portion and an inner surface portion that is spaced from the outer surface of the body to define a piston chamber exposed to the opening;

a piston arranged in the piston chamber; and a liner hanger running tool including a dog key extending into the opening and engaging the piston, the dog key being selectively shiftable relative to the liner hanger to release the piston and expose the opening to a setting pressure.

2. The liner hanger running system according to claim 1, wherein the liner hanger running tool includes a dog support sleeve that selectively retains the dog key in the opening.

3. The liner hanger running system according to claim 2, wherein the piston includes an end portion that selectively extends over a portion of the opening, the end portion including a recess receptive of the dog key.

4. The liner hanger running system according to claim 3, wherein the dog key includes a first end and a second end having a first portion including a first dimension and a second portion having a second dimension that is less than the first dimension, the second portion extending into the recess.

5. The liner hanger running system according to claim 4, wherein the first portion of the dog key includes a seal.

6. The liner hanger running system according to claim 4, wherein the first end of the dog key includes a flange element that selectively abuts the dog support sleeve.

7. A resource exploration and recovery system comprising:

a surface system;

a subsurface system including a well bore, a casing extending into the wellbore, and a liner hanger running system comprising:

a liner hanger including a body having a wall defined by an outer surface and an inner surface, the body including an opening that extends through the outer surface and the inner surface;

a piston housing including a wall portion defined by an outer surface portion and an inner surface portion that is spaced from the outer surface of the body to define a piston chamber exposed to the opening;

a piston arranged in the piston chamber; and a liner hanger running tool including a dog key extending into the opening and engaging the piston, the dog key being selectively shiftable relative to the liner hanger to release the piston and expose the opening to a setting pressure.

8. The resource exploration and recovery system according to claim 7, wherein the liner hanger running tool includes a dog support sleeve that selectively retains the dog key in the opening.

9. The resource exploration and recovery system according to claim 8, wherein the piston includes an end portion that selectively extends over a portion of the opening, the end portion including a recess receptive of the dog key.

10. The resource exploration and recovery system according to claim 9, wherein the dog key includes a first end and a second end having a first portion including a first dimension and a second portion having a second dimension that is less than the first dimension, the second portion extending into the recess.

11. The resource exploration and recovery system according to claim 10, wherein the first portion of the dog key includes a seal.

12. The resource exploration and recovery system according to claim 10, wherein the first end of the dog key includes a flange element that selectively abuts the dog support sleeve.

13. The resource exploration and recovery system according to claim 7, wherein the liner hanger includes an anchor, the piston being operatively connected to the anchor.

14. The resource exploration and recovery system according to claim 13, wherein the anchor includes at least one slip arranged on the outer surface.

15. A method of shifting a piston in a liner hanger, the method comprising running a liner hanger into a wellbore on a liner hanger running tool;

releasing a dog key extending through an opening in the liner hanger into a piston chamber and engaging a piston;

directing fluid through the opening into the piston chamber; and shifting the piston in the piston chamber.

16. The method of claim 15, wherein running the liner hanger into the well bore includes sealing the opening with the dog key to prevent solid-laden fluids to pass into the piston chamber.

17. The method of claim 15, wherein releasing the dog key includes shifting the liner hanger running tool relative to the liner hanger.

18. The method of claim 17, wherein shifting the liner hanger running tool releases the dog key to move radially inwardly.

19. The method of claim 17, wherein shifting the liner hanger running tool includes axially moving a support sleeve relative to the dog key.

20. The method of claim 15, wherein releasing the dog key includes disengaging an end of the dog key from a recess in the piston.

* * * * *